US007117636B2

(12) United States Patent
Gann

(10) Patent No.: US 7,117,636 B2
(45) Date of Patent: Oct. 10, 2006

(54) SIMULTANEOUSLY OPERATING SELF BALANCED HUNG WINDOW

(75) Inventor: Richard John Gann, Centennial, CO (US)

(73) Assignee: Custom Window Company, Inc., Englewood, CO (US)

( * ) Notice: Subject to any disclaimer, the term of this patent is extended or adjusted under 35 U.S.C. 154(b) by 92 days.

(21) Appl. No.: 10/756,979

(22) Filed: Jan. 13, 2004

(65) Prior Publication Data

US 2005/0055881 A1 Mar. 17, 2005

Related U.S. Application Data

(60) Provisional application No. 60/501,933, filed on Sep. 11, 2003.

(51) Int. Cl.
*E05C 7/06* (2006.01)

(52) U.S. Cl. ..... 49/123; 49/116

(58) Field of Classification Search ..... 49/116, 49/119, 121, 123
See application file for complete search history.

(56) References Cited

U.S. PATENT DOCUMENTS

| | | | | | |
|---|---|---|---|---|---|
| 1,119,365 | A | * | 12/1914 | Morris | 49/99 |
| 1,916,681 | A | * | 7/1933 | William | 49/149 |
| 3,065,507 | A | * | 11/1962 | Cloutier et al. | 49/63 |
| 3,133,323 | A | * | 5/1964 | Robards | 49/174 |
| 3,146,488 | A | * | 9/1964 | Dahlstrom | 16/198 |
| 3,600,854 | A | * | 8/1971 | Dallaire et al. | 49/51 |
| 4,399,855 | A | | 8/1983 | Volfson | 160/23 |
| 4,648,206 | A | | 3/1987 | Moriya et al. | 49/352 |
| 4,685,175 | A | | 8/1987 | Yonovich | 16/197 |
| D299,544 | S | | 1/1989 | Nolan | D25/52 |
| 4,803,809 | A | | 2/1989 | Takemura | 49/404 |
| 4,813,180 | A | | 3/1989 | Scalzi | 49/161 |
| 5,035,081 | A | | 7/1991 | Yamamoto et al. | 49/161 |
| D321,126 | S | | 10/1991 | Westphal et al. | D8/380 |
| 5,070,927 | A | | 12/1991 | Chen | 160/344 |
| 5,111,615 | A | | 5/1992 | Kuhnt et al. | 49/279 |
| 5,331,765 | A | * | 7/1994 | Dupuis et al. | 49/121 |
| 5,379,824 | A | | 1/1995 | Carvalho | 160/90 |
| 5,383,303 | A | | 1/1995 | Nakanishi et al. | 49/181 |
| 5,400,557 | A | | 3/1995 | Glover | 52/201 |
| 5,440,837 | A | | 8/1995 | Piltingsrud | 49/139 |
| 5,515,652 | A | | 5/1996 | Klimek | 49/501 |
| D394,115 | S | | 5/1998 | Bruchu et al. | D25/52 |
| 5,836,119 | A | | 11/1998 | Emmanuel | 52/204.71 |
| 5,850,711 | A | | 12/1998 | Takahashi et al. | 49/351 |
| 5,855,092 | A | | 1/1999 | Raap et al. | 49/181 |

(Continued)

FOREIGN PATENT DOCUMENTS

GB 2343213 A * 5/2000

*Primary Examiner*—Jerry Redman
(74) *Attorney, Agent, or Firm*—Sheridan Ross P.C.

(57) ABSTRACT

A hung window includes upper and lower sashes that may operate simultaneously. Two or more pulleys or rollers are mounted at each lateral side of the window frame. A cable interconnects each lateral side of the upper and lower sashes. The cables are routed over the pulleys thereby suspending the sashes and allowing simultaneous movement of the upper and lower sash when force is applied either to raise the lower sash or lower the upper sash. This arrangement allows the hung window to be self-balancing thereby eliminating special hardware typically needed to balance the window. Simultaneous movement of the upper and lower sashes also enables the upper and lower sashes to create openings for increased air circulation within an adjacent room.

11 Claims, 6 Drawing Sheets

U.S. PATENT DOCUMENTS

| | | | | |
|---|---|---|---|---|
| 6,199,323 | B1 | 3/2001 | Autovino | 49/428 |
| 6,202,373 | B1 | 3/2001 | Lindgren | 52/200 |
| 6,282,839 | B1 | 9/2001 | Fischer et al. | 49/352 |
| 6,460,294 | B1 | 10/2002 | Harkins | 49/345 |
| 6,530,175 | B1 | 3/2003 | Sato et al. | 49/138 |
| 6,698,139 | B1 | 3/2004 | Scholes | 49/447 |
| 6,701,670 | B1 * | 3/2004 | Evans | 49/123 |

* cited by examiner

SIMULTANEOUSLY OPERATING SELF BALANCED HUNG WINDOW

CROSS REFERENCE TO RELATED APPLICATION

This application claims priority from U.S. Provisional Patent Application No. 60/501,933, filed Sep. 11, 2003. The entire disclosure of the provisional application is considered to be part of the disclosure of the accompanying application and is hereby incorporated by reference.

TECHNICAL FIELD

The present invention relates generally to windows for structures such as buildings or homes, and more particularly, to a hung window having upper and lower sashes that are balanced and that operate simultaneously when the lower sash is lifted.

BACKGROUND OF THE INVENTION

In the construction industry, there are a great number of window designs which can be used for various manmade structures. For windows that are intended to be manually operated in order to open and close, there are also numerous available designs. For windows that are manually operated, consideration must be given as to providing a user the ability to operate the window without exerting an unnecessary amount of force.

One type of window design that is commonly used in residential and commercial structures is the hung window. A hung window typically includes two or more sashes arranged in a vertical orientation, i.e., one sash above and the other sash below. One of the sashes may typically be operated to open or close. Because of the weight of the operable sash that must be overcome in order to move the operable sash, a number of designs have been developed in order to mechanically assist the user thereby reducing the amount of force necessary to operate the sash in order to maintain the sash in any desired position.

Two very common ways to mechanically assist in operation of the lower sash includes spiral balances or block and tackle balances. In most cases, both the spiral balances and the block and tackle balances are spring assisted. There are numerous disadvantages to both spiral and block and tackle balances. For such spring assisted balances, they are difficult to repair because the window must be disassembled in order to access the working parts for replacement. Spring assisted balances easily wear out and there are limits as to the weight of an individual sash that can be operated with such balances.

Despite the numerous designs that exist for hung windows, there still exists a need for a hung window which has a simple yet reliable construction, and allows a user to operate the sashes with a minimum effort, regardless of the size or weight of the sashes.

SUMMARY OF THE INVENTION

In accordance with the present invention, a simultaneously operating self-balanced hung window is provided. Additionally, a method is provided for operating a hung window. The window of the present invention in a preferred embodiment includes two sashes arranged in a vertical orientation. The two sashes may be referred to as an upper sash and a lower sash. One or more cables interconnect the sashes to one another. Each cable is routed over one or more pulleys which thereby enables simultaneous operation of the sashes. As the lower sash of the window is raised, the upper sash is lowered. The purpose of this arrangement is to have the upper and lower sashes move simultaneously with only one force acting on the window, namely, a force to lift the lower sash. Alternatively, of course, the upper and lower sashes may also move simultaneously when a force is applied to the upper sash. Through the arrangement of the interconnected upper and low sashes, the upper sash acts as a counterweight thereby assisting a user in raising the lower sash. No additional hardware is required for providing a counterbalance.

In the preferred embodiment of the present invention, there are a pair of cables used to connect both lateral sides of the upper and lower sashes, and a pair of pulleys or rollers are installed within the window frame adjacent each lateral side of the sashes thereby allowing simultaneous operation of the upper and lower sashes. By placing a cable at both lateral sides of the sashes, the lifting force from a user is more evenly distributed across the lower sash thereby preventing the lower sash from being lifted in a manner which causes the lower sash to become misaligned or jammed against the frame of the window.

Depending upon the particular size and design of the upper and lower sashes, it may be necessary to add weight to either the upper or lower sash in order to achieve desired balancing between the two sashes. For example, if the lower sash is much larger than the upper sash, then it may be necessary to add some weight to the upper sash, thereby ensuring that the upper sash can effectively counteract the weight of the lower sash. Alternatively, if the upper sash is much larger than the lower sash, it may be necessary to add some weight to the lower sash to ensure that the sashes are relatively balanced, and in this case, to prevent the sashes from inadvertently opening.

The distances that the upper and lower sashes travel during operation are preferably equal; however, it is also contemplated that it may be necessary or desired to have differences between the distances in which the sashes move. Also, it may be required to limit the distance of travel of the sashes for safety requirements. If differential travel is desired between the sashes, then various additional pulleys can be used to achieve differential travel. If it is simply desired to limit the travel of the sashes, then stops may be incorporated within the window frame, as further discussed below.

In addition to adjusting the actual weights of the upper and lower sashes to thereby accommodate a desired balancing between the sashes, an alternative is to provide one or more additional pulleys whereby the force that is exerted when lifting the lower sash can be mechanically enhanced through use of the additional pulley(s). For example, a third pulley could be used in conjunction with each pair of pulleys to provide the desired mechanical advantage. The third pulley would be mounted within the window frame adjacent each lateral side of the sashes or mounted on the sash.

The pulleys and cables may be mounted within the interior channels of each side of the window frame, thereby allowing a user to adjust the length of the cables as necessary, or to otherwise service the cables and pulleys without having to disassemble the window.

In another aspect of the present invention, a method is provided for manipulating sashes of a hung window whereby the sashes can be balanced with respect to one another. Also in accordance with this method, it is contemplated that the upper and lower sashes may travel similar or the same distances, or differential distances. Additionally, the method contemplates balancing of the sashes either through adding necessary weight to one of the sashes, or utilizing a the alternative pulley arrangement, as discussed above, to handle any differential weight between the sashes.

One distinct advantage of the present invention is the ability to counter balance large or heavy sashes that otherwise exceed the capacities of traditional spring assisted balances.

Another advantage of the present invention is the ability to improve air circulation within a room by providing openings in the hung window at the top and bottom of the window, yet only requiring application of a single force to operate the window. In order to evenly cool or ventilate an air space within a building, it is desirable to have at least some circulation which better mixes stratified airstreams. With the hung window of the present invention, the dual openings created by the simultaneously operated sashes enhance air circulation through convection because air may enter one opening and exit the other opening.

Other features and advantages of the present invention will become apparent by a review of the following figures, taken in conjunction with the detailed description.

DETAILED DESCRIPTION

Figure 1:
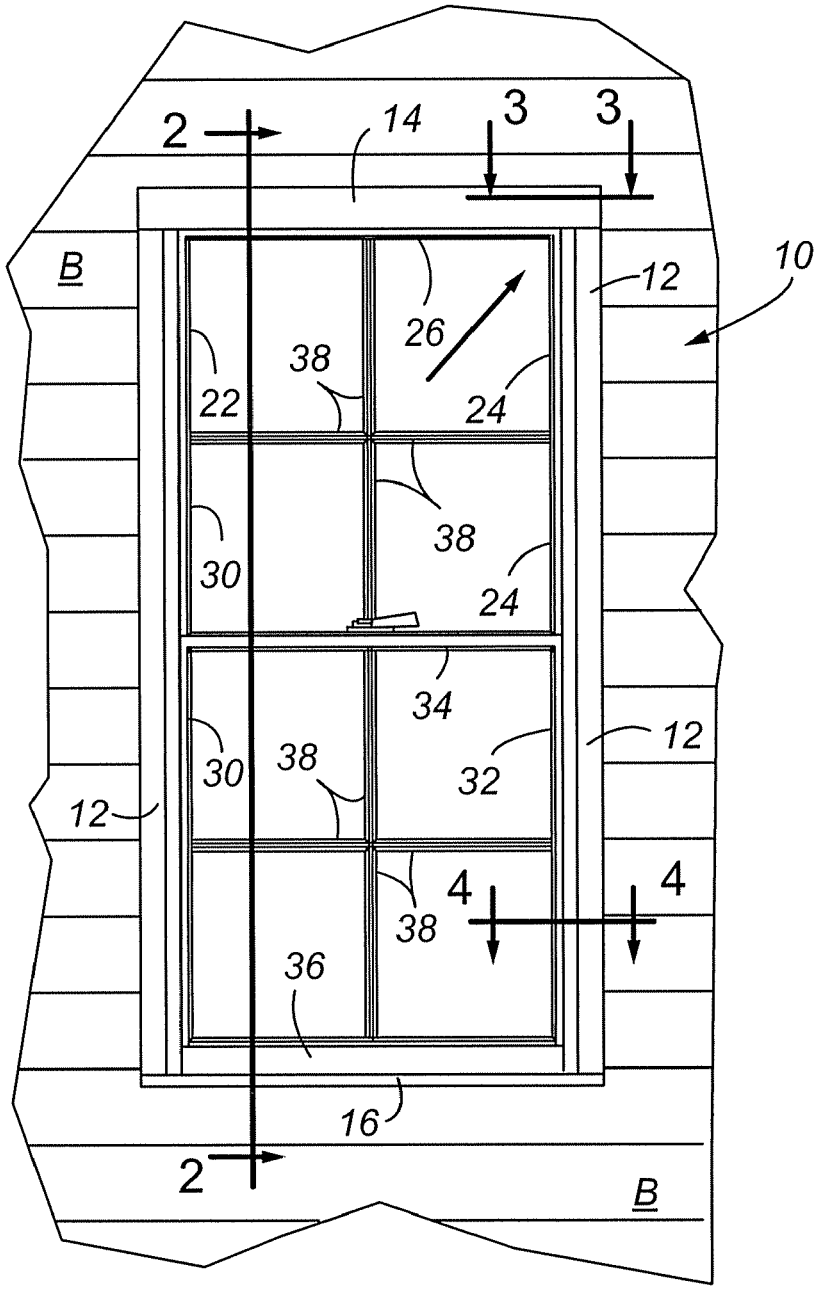
FIG. 1 is an elevation view of the hung window of the present invention installed within a structure.
Figure 2:
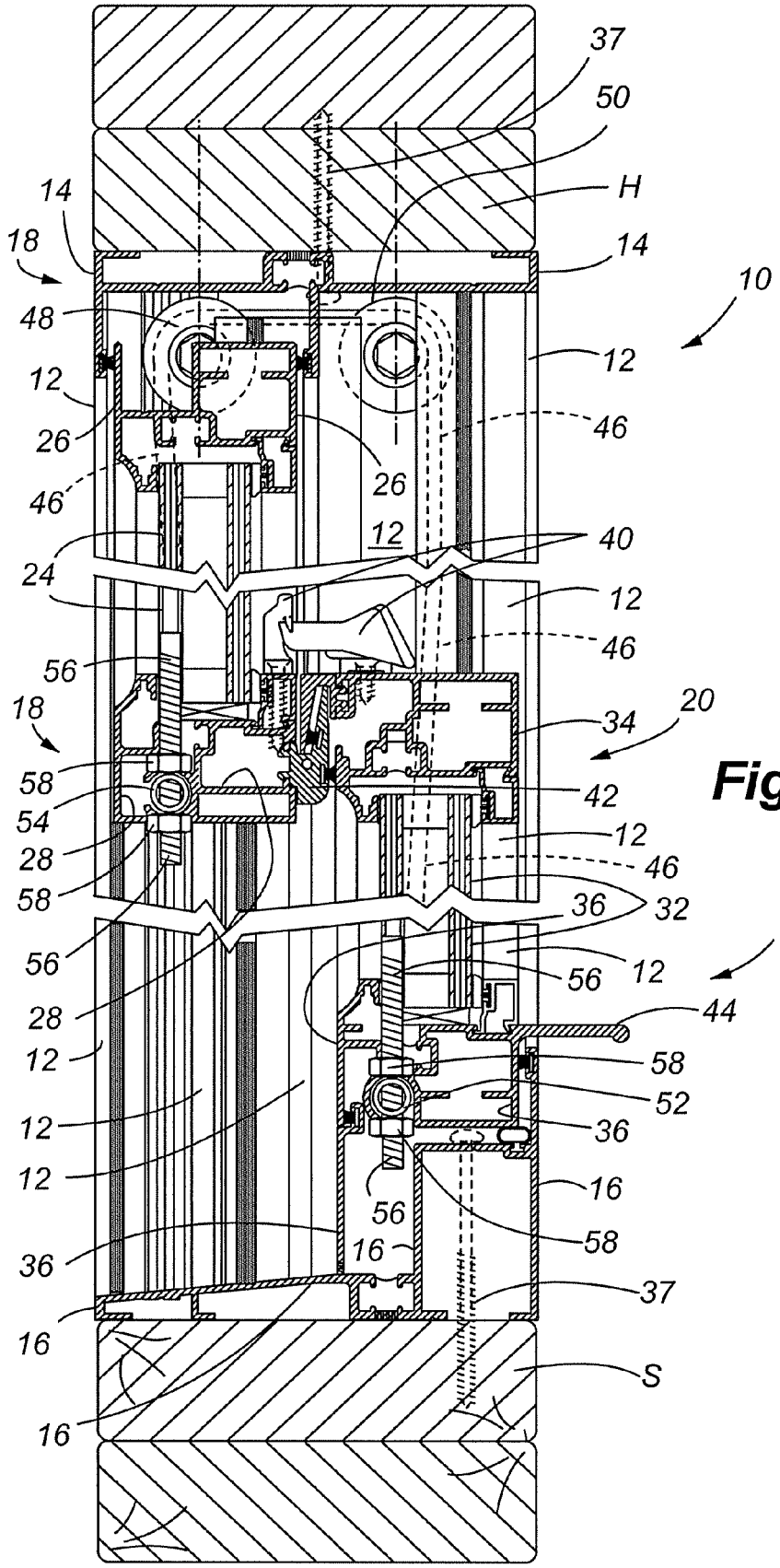
FIG. 2 is a fragmentary vertical section taken along line 2—2 of FIG. 1.

Referring to FIG. 1 and FIG. 2, the hung window of the present invention is shown installed within a common building B. Molding around the window is not shown in order to view the window frame elements. The window 10 includes the frame defined by a pair of vertical frame members 12 that are interconnected by a horizontally extending upper frame member 14 and a horizontally extending lower frame member 16 or sill. An upper sash 18 and lower sash 20 (FIG. 2) are sized to fit within the frame so that both the upper and lower sash may slide in a vertical manner within channels formed within the vertical frame members 12. The vertical frame members define the lateral sides of the window. The upper sash 18 may be of a standard construction to include a pair of spaced vertical supports 22 and 24 which are interconnected by upper and lower horizontal supports 26 and 28. The construction of the lower sash may be the same as the upper sash. Accordingly, the lower sash also may include a pair of spaced vertical supports 30 and 32 interconnected by horizontally extending upper and lower supports 34 and 36. Any desired decorative design can be used for the window elements which are supported within the upper and lower sashes. In the example shown in FIG. 1, the upper and lower sashes each include one or more glazing supports 38 which may result in multiple panes per sash.

Figure 3:
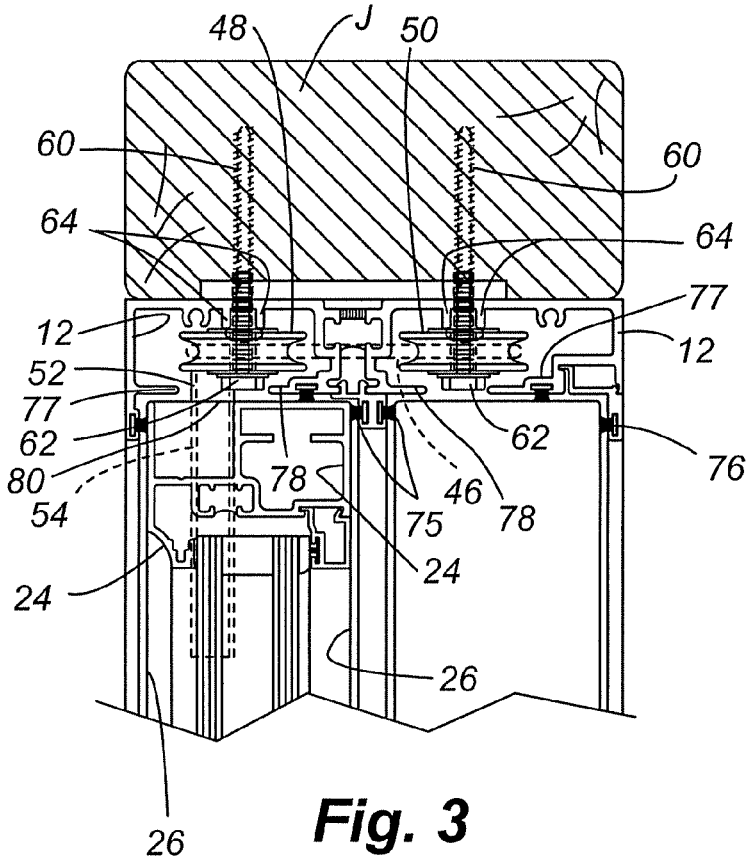
FIG. 3 is a horizontal section taken along line 3—3 of FIG. 1.
Figure 4:
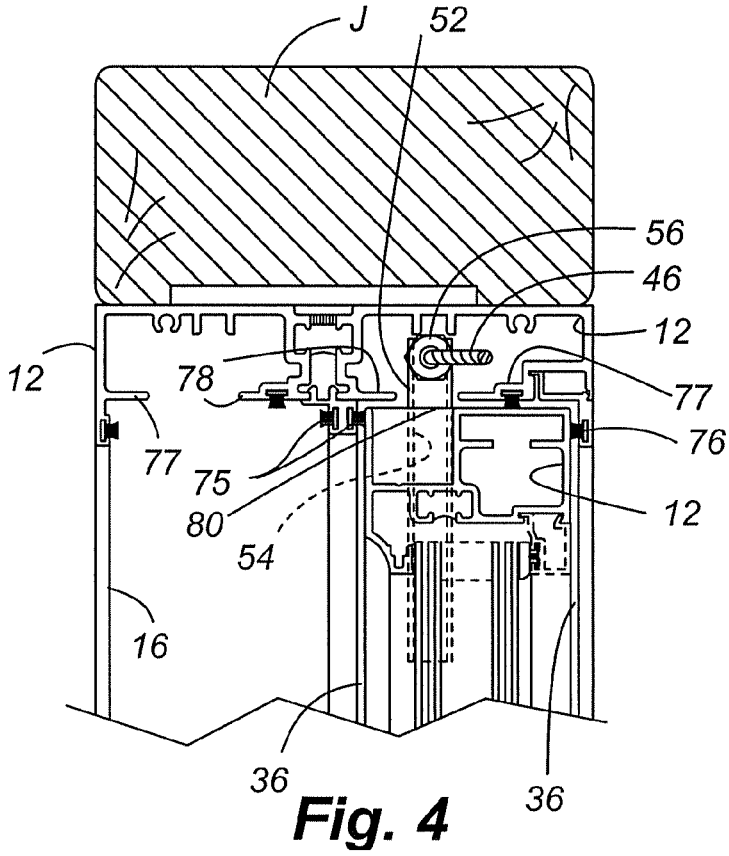
FIG. 4 is another horizontal section taken along line 4—4 of FIG. 1.

Referring now to FIG. 2, internal structural details of the window can be seen. The window 10 is mounted between a head H and a sill S that define the upper and lower edges of a window opening formed in the building. The upper frame member 14 is secured to the head H as by one or more screws or bolts 37. Similarly, the lower frame member or sill 16 is secured to the sill S as by one or more screws 37. The frame members 12, 14 and 16 as well as the supports of the upper and lower sashes may have a desired cross sectional shape which facilitates the mounting/emplacement of various seals or weather strips as necessary to seal the sashes within the window frame. For example, as best seen in FIGS. 3 and 4, a parting stop 75 and a weather seal 76 may be provided. FIG. 2 shows the lower sash in the closed position. Optionally, a conventional window locking mechanism 40 may be mounted to the upper and lower sashes enabling a user to selectively lock the window. Additionally, a conventional interlock mechanism 42 may also be incorporated in the design of the upper and lower sashes to prevent inadvertent movement of the sashes after being locked and to provide a weather seal. The lower sash may include a lifting rail 44 which can be grasped by a user in order to operate the window.

Figure 5:
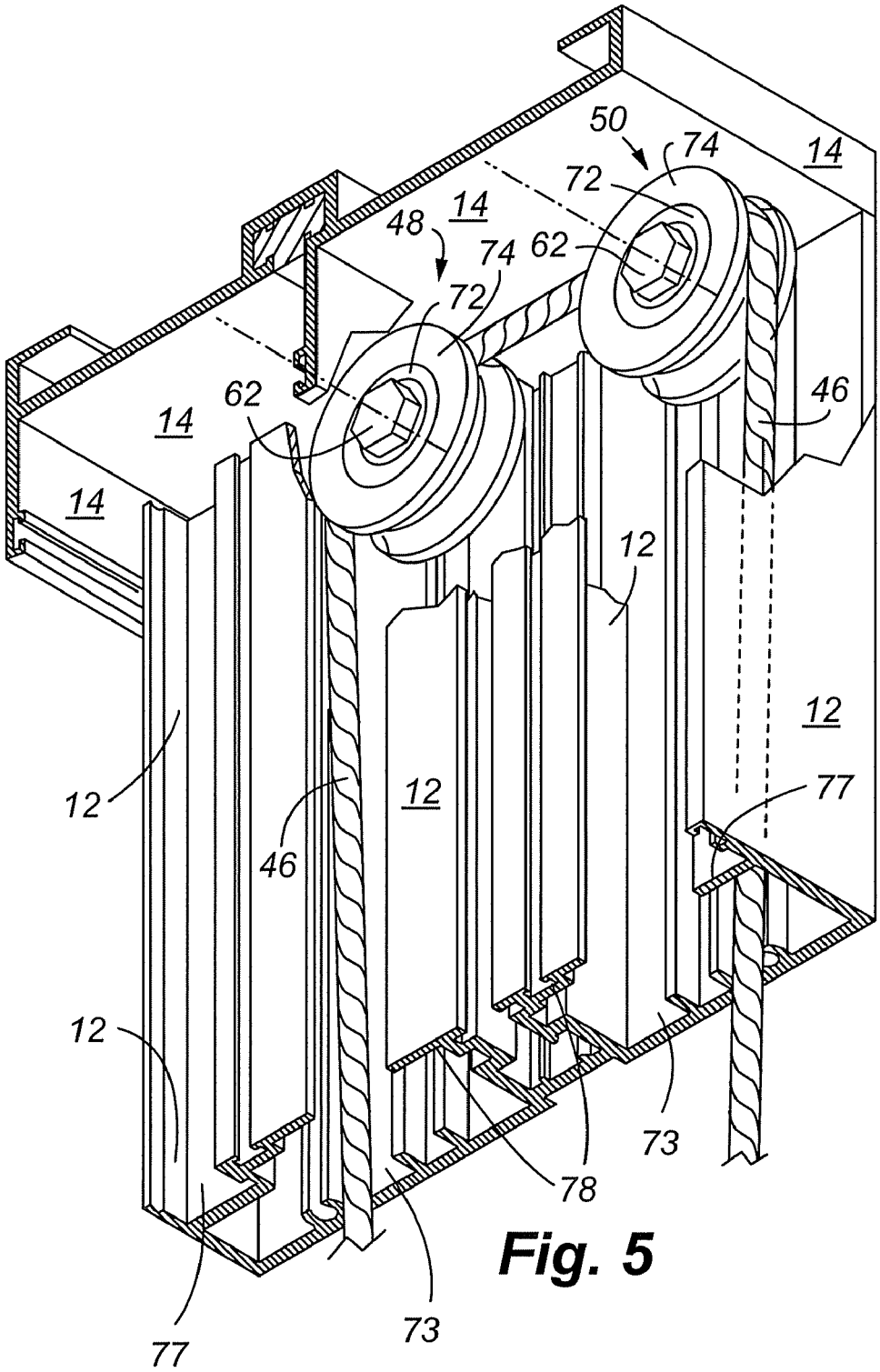
FIG. 5 is an enlarged fragmentary perspective view illustrating the preferred arrangement of a cable and pair of pulleys mounted within the window frame.

FIG. 5 illustrates one lateral side of the window frame. Each frame member 12 has a pair of vertical channels 73 that allow the sashes (not shown) to travel Therein. A pair of pulleys 48 and 50 are mounted against the exposed interior surface of each vertical frame member 12. Each cable 46 is routed over the corresponding pair of pulleys. One end of each of the cables 46 attaches to a lateral side of the lower sash while The other end of each of the cables 46 attaches to a lateral side of the upper sash. As also shown in FIG. 5. the channels 73 are defined by a pair of exterior frame elements 77 and an intermediate frame element 78 positioned between a pair of exterior frame elements 77, said intermediate frame element 78 separating said pair of channels 73.

Figure 6:
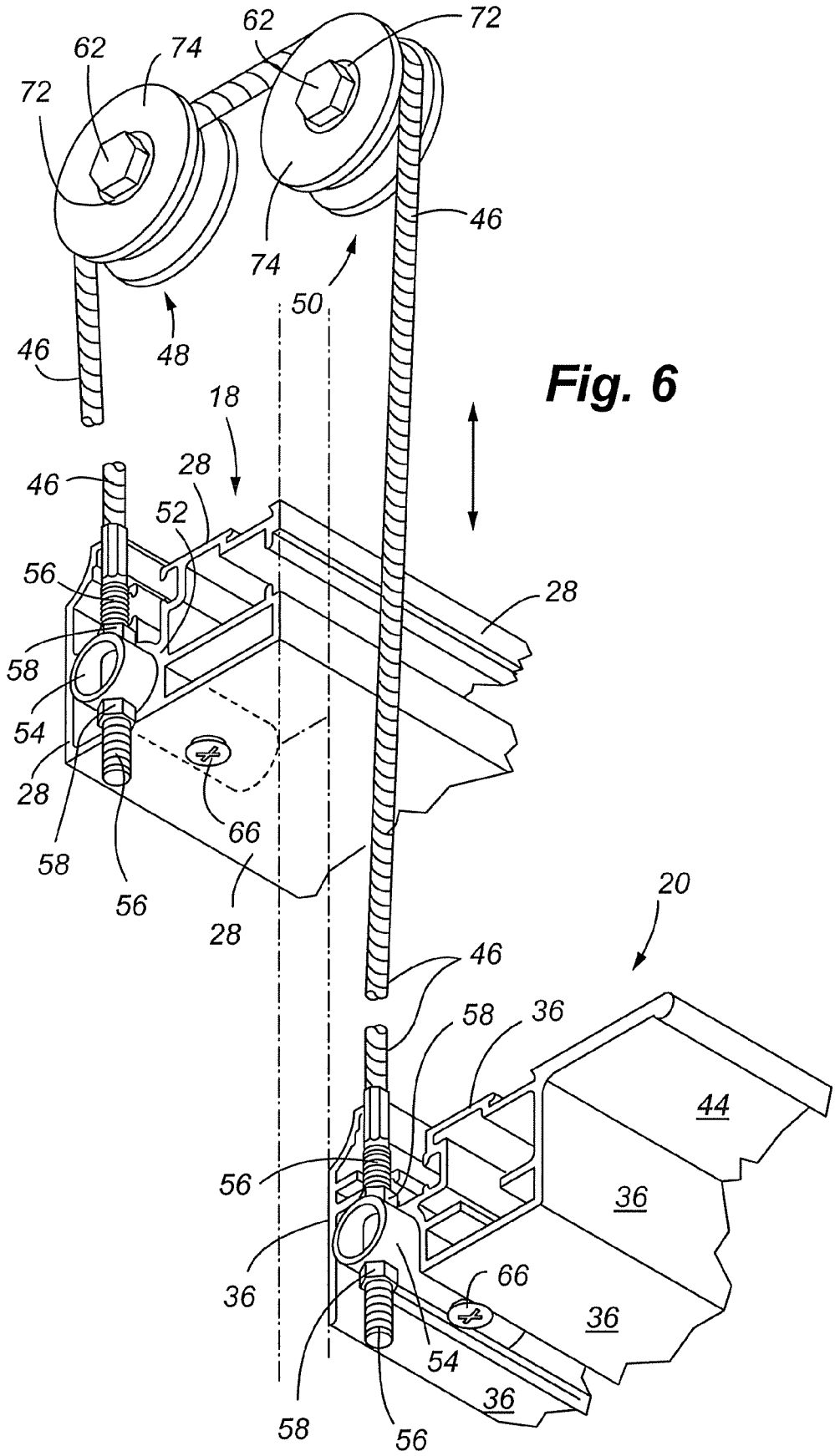
FIG. 6 is an enlarged fragmentary perspective view illustrating attachment of the ends of a cable to an upper sash and a lower sash, and relative alignment of a pair of pulleys with the cable.

FIG. 6 illustrates the other pair of pulleys 48 and 50 as they are attached to the respective lower supports of the upper and lower sashes. As shown, the lower support 36 of the lower sash may include a cylindrical opening 52 that receives a horizontally extending anchor 54. A transverse hole intersects opening 52 and the anchor 54 enabling a threaded end 56 of the cable 46 to extend therethrough. One or more nuts 58 may be installed over the portion of the threaded cable end which extends between the opening 52 and the anchor 54. The lower support 28 of the upper sash is of a similar construction which allows the opposite end of the cable 46 to be secured to the lower support 28. Accordingly, the opposite threaded end 56 again extends through a cylindrical opening 52 and an anchor 54. One or more nuts 58 may be mounted over the section of the threaded cable end which extends between the opening 52 and the anchor 54. In order to prevent the anchors 54 from sliding within the respective openings 52, fasteners 66 may be used to connect the anchors to their corresponding horizontal supports. The opposite lateral side of the sashes may be constructed in the same way as shown in FIG. 6, thereby allowing the mounting of the other cable 46 and the other pair of pulleys 48 and 50.

If it is desired to adjust a length of a cable 46, the user may simply move the nut(s) along the length of the threaded section. By adjusting the effective length of the cable 46, the travel and positioning of the sashes may be controlled to match the frame of the window. It is desirable to have much of the weight of the sashes suspended by the pairs of pulleys, and the sashes should be positioned so that they may seal the window when the window is in the closed position.

Referring back to FIG. 3, the horizontal cross section of this figure illustrates the manner in which pulleys 48 and 50 are mounted to their respective vertical frame member 12. Frame member 12 may have a pair of spaced mounts 64 with horizontal openings which allow bolts 60 to extend therethrough. The heads 62 of The bolts 60 are tightened as required to seat the pulleys against the mounts 64. As best seen in FIG. 6, pulleys 48 and 50 may be of a conventional pulley construction wherein each pulley has a stationary internal section 72, and a rotating exterior section 74. Sealed bearings (not shown) enable rotation of the outer sections 74 around their respective inner sections 72. The pulleys 48 and 50 are preferably spaced horizontally from one another a distance so that the free ends of the cables may extend vertically to connect to the respective lower supports of the sashes. As also shown in FIGS. 3 and 4, the pulleys 48 and 50 are mounted in the channels 73 such that the pulleys are laterally offset from and separated from lateral edges 80 of said sashes.

Figure 7:
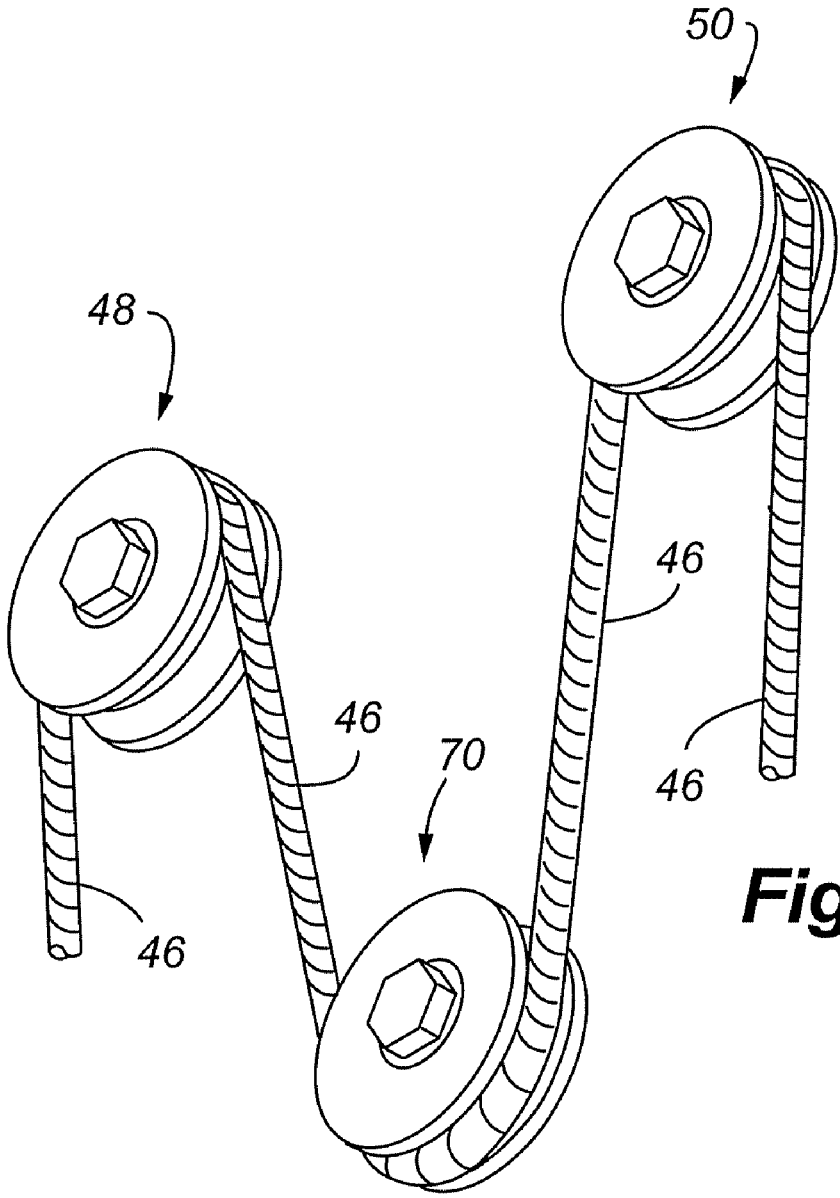
FIG. 7 is an enlarged fragmentary perspective view illustrating an alternative pulley arrangement to include the use of a third pulley to provide a user a mechanical advantage in operating the sashes.

Now referring to FIG. 7, an alternative arrangement is shown wherein an additional pulley 70 provides a user with a mechanical advantage in operating the sash. As shown, the additional pulley 70 is situated between the pair of pulleys 48 and 50. The cable 46 is routed such that it traverses under the pulley 70. Conveniently, the pulley 70 may also be mounted within the vertical frame member 12, and may be sized so that the width of the frame member 12 does not have to be altered. Accordingly, it may be necessary to make the third pulley 70 of a smaller diameter than that of pulleys 48 and 50. With the arrangement shown in FIG. 7, the user would obtain a two to one mechanical advantage in either lifting the lower sash or lowering the upper sash. Those skilled in the art can envision additional ways in which additional pulleys can be provided to yet further enhance the mechanical advantage required in a pulley arrangement.

The frame members and sash supports may be made from aluminum, or any other advantageous materials. The cable design, the channels of the pulleys, and the diameter of the cables may be matched to provide optimal performance in terms of frictional losses or other considerations.

Although it is preferable to have a cable and a pair of pulleys installed at each lateral side of the sashes, the present invention is functional with only one cable and a pair of pulleys installed at one lateral side.

The advantages of the present invention are clear. Simple yet effective means are provided enabling a hung window of virtually any size or weight to be operated in a manner that does not require extensive additional hardware to mechanically assist a user in operating the window. A combination of cables and pulleys can be incorporated within a traditional hung window design that allows the window to be self balanced, and that also enables simultaneous movement of the upper and lower sashes.

In accordance with the method of the present invention, the method provides a way to manipulate the sashes of a hung window thereby requiring only a single force to be applied to simultaneously move the upper and lower sashes. In accordance with the method, a window construction is provided in the form of a hung window including an upper sash which is mounted in the frame and slideable therein, and a lower sash mounted in the frame and slideable therein. Means are provided to allow force to be transmitted from one sash to another. One or more pairs of pulleys and a corresponding cable or cables are used to transmit force between the sashes. The cables interconnect the upper and lower sashes. To operate the sashes, the upper or lower sash is grasped. A force is then exerted in the direction desired to open or close the sashes. If the lower sash is grasped and an upward force is applied, the lower sash will be lifted while the upper sash will be simultaneously lowered. Alternatively, if a force is applied to the upper sash in a downward direction, the upper sash will be lowered and the lower sash will be lifted. As mentioned above, a user may selectively balance the weight of the upper sash with respect to the lower sash thereby optimizing an amount of force necessary to raise the lower sash, or alternatively, lower the upper sash. In a preferred embodiment, the upper and lower sashes travel equal distances with respect to one another. However, it is also within the spirit and scope of the invention to allow differential travel distances between the sashes, as also mentioned above. In lieu of balancing the sashes by adjusting the weights of the sashes, the method of the present invention also envisions use of one or more additional pulleys thereby providing a user a mechanical advantage to operate the sashes.

Although the apparatus and method of the invention have been provided in a preferred embodiment, it shall be understood that various other changes and modifications may be made within the spirit and scope of the present invention.

What is claimed is:

1. A hung window comprising:

a frame defining an opening, said frame including a pair of spaced vertical frame members, an upper frame member interconnecting upper ends of said vertical frame members, and a lower frame member interconnecting lower ends of said vertical frame members, each said vertical frame member having a pair of vertically extending channels formed thereon, said channels being defined by a pair of exterior frame elements and an intermediate frame element positioned between the pair of exterior frame elements and said intermediate frame element separating said pair of channels;

an upper sash mounted in the frame and slidable in an opposing pair of said channels;

a lower sash mounted in the frame and slidable in another opposing pair of said channels;

a pair of pulleys secured to the frame, one pulley of said pair of pulleys being mounted in one channel of said pair of channels, and the other pulley of said pair of pulleys being mounted in the other channel of said pair of channels, said pulleys being laterally offset from and separated from lateral edges of said sashes; and a cable having a first end connected to the upper sash and a second end connected to the lower sash, said cable being routed over said pair of pulleys wherein lifting said lower sash causes said upper sash to be lowered.

2. A window, as claimed in claim 1, wherein:

a weight of said lower sash is adjusted to balance a weight of said upper sash thereby optimizing an amount of force required to lift the lower sash.

3. A window, as claimed in claim 1, wherein:

said lower sash and said upper sash are approximately equal in weight.

4. A window, as claimed in claim 1, wherein:

said pair of pulleys are spaced from one another horizontally within the frame.

5. A window, as claimed in claim 1, wherein;

said upper sash includes a lower frame support;

said lower sash includes a lower frame support; and said cable attaches to said upper and lower sashes at said respective lower frame supports thereof.

6. A window, as claimed in claim 1, wherein:

said cable has means attached at both ends thereof for adjusting a length of the cable spanning between said upper sash and said lower sash.

7. A hung window comprising:

a frame defining an opening, said frame including a pair of spaced vertical frame members, an upper frame member interconnecting upper ends of said vertical frame members, and a lower frame member interconnecting lower ends of said vertical frame members, each said vertical frame member having a pair of vertically extending channels formed thereon, said channels being defined by a pair of exterior frame elements and an intermediate frame element positioned between the pair of exterior frame elements and said intermediate frame element separating said pair of channels;

an upper sash mounted in the frame and slidable in an opposing pair of said channels;

a lower sash mounted in the frame and slidable in another opposing pair of said channels;

a cable having a first end connected to said upper sash and having a second end connected to said lower sash; and means mounted in said frame and within the opening defined by said frame for enabling simultaneous movement of said upper and lower sashes, said cable being engaged with said means for enabling simultaneous movement, wherein lifting said lower sash results in said upper sash being lowered, said means for enabling simultaneous movement being mounted in said channels and being laterally offset from and separated from lateral edges of said sashes; and said cable has means attached at one end thereof for adjusting a length of the cable spanning between said upper sash and said lower sash.

8. A window, as claimed in claim 7, wherein:

a weight of said lower sash is adjusted to balance a weight of said upper sash thereby optimizing an amount of force required to lift the lower sash.

9. A window, as claimed in claim 7, wherein:

said lower sash and said upper sash are approximately equal in weight.

10. A window, as claimed in claim 7, wherein;

said upper sash includes a lower frame support;

said lower sash includes a lower frame support; and said cable attaches to said upper and lower sashes at said respective lower frame supports thereof.

11. A hung window comprising:

a frame having a pair of spaced and substantially parallel vertical frame members, and a pair of horizontally extending frame members interconnecting said vertical frame members;

an upper sash mounted in opposing aligned channels of the vertical frame members and slidable therein;

a lower sash mounted in second opposing aligned channels of the vertical frame members and slidable therein;

a first pair of pulleys mounted in one vertical frame of said pair of vertical frame members;

a second pair of pulleys mounted in the other vertical frame of said pair of vertical frame members, said channels of said vertical frame members being defined by a pair of exterior frame elements in each vertical frame and an intermediate frame element positioned between the pair of exterior frame elements in each vertical frame;

a first cable having a first end connected to one lateral edge of said upper sash and having a second end connected to an adjacent lateral edge of said lower sash, said first cable being routed over said first pair of pulleys;

a second cable having a first end connected to the opposite lateral edge of said upper sash and having a second end connected to the opposite lateral edge of said lower sash, said second cable being routed over said second pair of pulleys, said pulleys being positioned laterally offset from and separated from the lateral edges of said sashes;

wherein lifting said lower sash causes said upper sash to be lowered and said cables remain in tension during movement of said sashes by rotation of said pairs of pulleys; and an interlock mechanism for sealing said upper sash with respect to said lower sash, said interlock mechanism being mounted adjacent an upper end of said lower sash and a lower end of said upper sash.

* * * * *